US008280728B2

(12) United States Patent
Chen et al.

(10) Patent No.: US 8,280,728 B2
(45) Date of Patent: Oct. 2, 2012

(54) PACKET LOSS CONCEALMENT FOR A SUB-BAND PREDICTIVE CODER BASED ON EXTRAPOLATION OF EXCITATION WAVEFORM

(75) Inventors: Juin-Hwey Chen, Irvine, CA (US); Jes Thyssen, Laguna Niguel, CA (US); Robert W. Zopf, Rancho Santa Margarita, CA (US)

(73) Assignee: Broadcom Corporation, Irvine, CA (US)

( * ) Notice: Subject to any disclaimer, the term of this patent is extended or adjusted under 35 U.S.C. 154(b) by 1394 days.

(21) Appl. No.: 11/835,716

(22) Filed: Aug. 8, 2007

(65) Prior Publication Data

US 2008/0040122 A1 Feb. 14, 2008

Related U.S. Application Data

(60) Provisional application No. 60/836,937, filed on Aug. 11, 2006.

(51) Int. Cl.

| | |
|---|---|
| ***G10L 19/00*** | (2006.01) |
| ***G10L 21/02*** | (2006.01) |
| ***G10L 13/00*** | (2006.01) |

(52) U.S. Cl. ..... 704/219; 704/228; 704/262

(58) Field of Classification Search ..... 704/219, 704/226–229, 262, 200.1, 500–504
See application file for complete search history.

(56) References Cited

U.S. PATENT DOCUMENTS

| | | | | |
|---|---|---|---|---|
| 5,550,543 | A * | 8/1996 | Chen et al. | 341/94 |
| 5,615,298 | A | 3/1997 | Chen | |
| 6,961,697 | B1 * | 11/2005 | Kapilow | 704/228 |
| 7,711,563 | B2 * | 5/2010 | Chen | 704/262 |
| 8,000,960 | B2 * | 8/2011 | Chen et al. | 704/219 |
| 2005/0143985 | A1 | 6/2005 | Sung et al. | |
| 2006/0271355 | A1 * | 11/2006 | Wang et al. | 704/220 |
| 2009/0248405 | A1 | 10/2009 | Chen et al. | |

OTHER PUBLICATIONS

Serizawa, Masahiro et al., "A Packet Loss Concealment Method Using Pitch Waveform Repetition and Internal State Update on the Decoded Speech for the Sub-band ADPCM Wideband Speech CODEC", Speech Coding, IEEE Workshop Proceedings, (Oct. 6-9, 2002), pp. 68-70.*

"ITU-T Recommendation G.722-7 kHz Audio-Coding within 65 KBIT/S", International Telecommunication Union, Geneva, Switzerland (Nov. 1988), pp. 1-73.

Gunduzhan, E. et al., "A Linear Prediction Based Packet Loss Concealment Algorithm for PCM coded Speech", IEEE Transactions on Speech and Audio Processing, vol. 9(8), (Nov. 2001), pp. 778-785.

* cited by examiner

*Primary Examiner* — Angela A Armstrong
(74) *Attorney, Agent, or Firm* — Fiala & Weaver P.L.L.C.

(57) ABSTRACT

Systems and methods are described for performing packet loss concealment using an extrapolation of an excitation waveform in a sub-band predictive speech coder, such as an ITU-T Recommendation G.722 wideband speech coder. The systems and methods are useful for concealing the quality-degrading effects of packet loss in a sub-band predictive coder and address some sub-band architectural issues when applying excitation extrapolation techniques to such sub-band predictive coders.

28 Claims, 7 Drawing Sheets

PACKET LOSS CONCEALMENT FOR A SUB-BAND PREDICTIVE CODER BASED ON EXTRAPOLATION OF EXCITATION WAVEFORM

CROSS-REFERENCE TO RELATED APPLICATIONS

This application claims priority to Provisional U.S. Patent Application No. 60/836,937, filed Aug. 11, 2006, the entirety of which is incorporated by reference herein.

BACKGROUND OF THE INVENTION

1. Field of the Invention

The present invention relates to systems and methods for concealing the quality-degrading effects of packet loss in a speech or audio coder.

2. Background Art

In digital transmission of voice or audio signals through packet networks, the encoded voice/audio signals are typically divided into frames and then packaged into packets, where each packet may contain one or more frames of encoded voice/audio data. The packets are then transmitted over the packet networks. Sometimes some packets are lost, and sometimes some packets arrive too late to be useful, and therefore are deemed lost. Such packet loss will cause significant degradation of audio quality unless special techniques are used to conceal the effects of packet loss. There exist prior-art packet loss concealment methods for full-band predictive coders based on an extrapolation of the excitation signal, which is sometimes also referred to as the prediction residual signal. For example, see U.S. Pat. No. 5,615,298 to Chen, entitled "Excitation Signal Synthesis during Frame Erasure or Packet Loss." However, issues arise when such techniques are applied to sub-band predictive coders such as the ITU-T Recommendation G.722 wideband speech coder due at least in part to the architecture of those coders. A sub-band predictive coder first splits an input signal into different frequency bands using an analysis filter bank and then applies predictive coding to each of the sub-band signals. At the decoder side, the decoded sub-band signals are recombined in a synthesis filter bank into a full-band output signal.

SUMMARY OF THE INVENTION

Embodiments of the present invention may be used to conceal the quality-degrading effects of packet loss (or frame erasure) in a sub-band predictive coder. Embodiments of the present invention address sub-band architectural issues when applying excitation extrapolation techniques to such sub-band predictive coders.

In particular, a system for replacing a portion of an audio signal that is deemed lost in a sub-band predictive coder is described herein. The system includes a first excitation extrapolator, a second excitation extrapolator, a first synthesis filter, a second synthesis filter, and a synthesis filter bank. The first excitation extrapolator is configured to generate a first sub-band extrapolated excitation signal based on a first sub-band excitation signal associated with one or more previously-received portions of the audio signal. The second excitation extrapolator is configured to generate a second sub-band extrapolated excitation signal based on a second sub-band excitation signal associated with one or more previously-received portions of the audio signal. The first synthesis filter is configured to filter the first sub-band extrapolated excitation signal to generate a synthesized first sub-band audio signal. The second synthesis filter is configured to filter the second sub-band extrapolated excitation signal to generate a synthesized second sub-band audio signal. The synthesis filter bank is configured to combine at least the synthesized first sub-band audio signal and the synthesized second sub-band audio signal to generate a full-band output audio signal corresponding to the portion of the audio signal that is deemed lost.

The foregoing system may further include a first decoder and a second decoder. The first decoder is configured to decode a first sub-band bit-stream associated with a portion of the audio signal that is not deemed lost and the second decoder is configured to decode a second sub-band bit-stream associated with the portion of the audio signal that is not deemed lost. The first decoder may be a low-band adaptive pulse code modulation (ADPCM) decoder and the second decoder may be a high-band ADPCM decoder. The first synthesis filter may be a low-band ADPCM decoder synthesis filter and the second synthesis filter may be a high-band ADPCM decoder synthesis filter.

A method for replacing a portion of an audio signal that is deemed lost in a sub-band predictive coder is also described herein. In accordance with the method, a first sub-band extrapolated excitation signal is generated based on a first sub-band excitation signal associated with one or more previously-received portions of the audio signal. A second sub-band extrapolated excitation signal is generated based on a second sub-band excitation signal associated with one or more previously-received portions of the audio signal. The first sub-band extrapolated excitation signal is filtered in a first synthesis filter to generate a synthesized first sub-band audio signal. The second sub-band extrapolated excitation signal is filtered in a second synthesis filter to generate a synthesized second sub-band audio signal. At least the synthesized first sub-band audio signal and the synthesized second sub-band audio signal are combined to generate a full-band output audio signal corresponding to the portion of the audio signal that is deemed lost.

The foregoing method may further include decoding a first sub-band bit-stream associated with a portion of the audio signal that is not deemed lost in a first decoder and decoding a second sub-band bit-stream associated with the portion of the audio signal that is not deemed lost in a second decoder. The first decoder may be a low-band ADPCM decoder and the second decoder may be a high-band ADPCM decoder. The first synthesis filter may be a low-band ADPCM decoder synthesis filter and the second synthesis filter may be a high-band ADPCM decoder synthesis filter.

An alternative system for replacing a portion of an audio signal that is deemed lost in a sub-band predictive coder is also described herein. The system includes a first synthesis filter bank, a full-band excitation extrapolator, an analysis filter bank, a first synthesis filter, a second synthesis filter, and a second synthesis filter bank. The first synthesis filter bank is configured to combine at least a first sub-band excitation signal associated with one or more previously-received portions of the audio signal and a second sub-band excitation signal associated with one or more previously-received portions of the audio signal to generate a full-band excitation signal. The full-band excitation extrapolator is configured to receive the full-band excitation signal and generate a full-band extrapolated excitation signal therefrom. The analysis filter bank is configured to split the full-band extrapolated excitation signal into at least a first sub-band extrapolated excitation signal and a second sub-band extrapolated excitation signal. The first synthesis filter is configured to filter the first sub-band extrapolated excitation signal to generate a synthesized first sub-band audio signal. The second synthesis filter is configured to filter the second sub-band extrapolated excitation signal to generate a synthesized second sub-band audio signal. The second synthesis filter bank is configured to combine at least the synthesized first sub-band audio signal and the synthesized second sub-band audio signal to generate a full-band output audio signal corresponding to the portion of the audio signal that is deemed lost.

The foregoing system may further include a first decoder and a second decoder. The first decoder is configured to decode a first sub-band bit-stream associated with a portion of the audio signal that is not deemed lost and the second decoder is configured to decode a second sub-band bit-stream associated with the portion of the audio signal that is not deemed lost. The first decoder may be a low-band ADPCM decoder and the second decoder may be a high-band ADPCM decoder. The first synthesis filter may be a low-band ADPCM decoder synthesis filter and the second synthesis filter may be a high-band ADPCM decoder synthesis filter.

An alternative method for replacing a portion of an audio signal that is deemed lost in a sub-band predictive coder is also described herein. In accordance with this alternative method, at least a first sub-band excitation signal associated with one or more previously-received portions of the audio signal and a second sub-band excitation signal associated with one or more previously-received portions of the audio signal are combined to generate a full-band excitation signal. A full-band extrapolated excitation signal is then generated based on the full-band excitation signal. The full-band extrapolated excitation signal is then split into at least a first sub-band extrapolated excitation signal and a second sub-band extrapolated excitation signal. The first sub-band extrapolated excitation signal is filtered in a first synthesis filter to generate a synthesized first sub-band audio signal. The second sub-band extrapolated excitation signal is filtered in a second synthesis filter to generate a synthesized second sub-band audio signal. At least the synthesized first sub-band audio signal and the synthesized second sub-band audio signal are then combined to generate a full-band output audio signal corresponding to the portion of the audio signal that is deemed lost.

The foregoing method may further include decoding a first sub-band bit-stream associated with a portion of the audio signal that is not deemed lost in a first decoder and decoding a second sub-band bit-stream associated with the portion of the audio signal that is not deemed lost in a second decoder. The first decoder may be a low-band ADPCM decoder and the second decoder may be a high-band ADPCM decoder. The first synthesis filter may be a low-band ADPCM decoder synthesis filter and the second synthesis filter may be a high-band ADPCM decoder synthesis filter.

Further features and advantages of the present invention, as well as the structure and operation of various embodiments of the present invention, are described in detail below with reference to the accompanying drawings. It is noted that the invention is not limited to the specific embodiments described herein. Such embodiments are presented herein for illustrative purposes only. Additional embodiments will be apparent to persons skilled in the art based on the teachings contained herein.

BRIEF DESCRIPTION OF THE DRAWINGS/FIGURES

The accompanying drawings, which are incorporated herein and form a part of the specification, illustrate one or more embodiments of the present invention and, together with the description, further serve to explain the purpose, advantages, and principles of the invention and to enable a person skilled in the art to make and use the invention.

The features and advantages of the present invention will become more apparent from the detailed description set forth below when taken in conjunction with the drawings. The drawing in which an element first appears is indicated by the leftmost digit(s) in the corresponding reference number.

DETAILED DESCRIPTION OF INVENTION

A. Introduction

Figure 1:
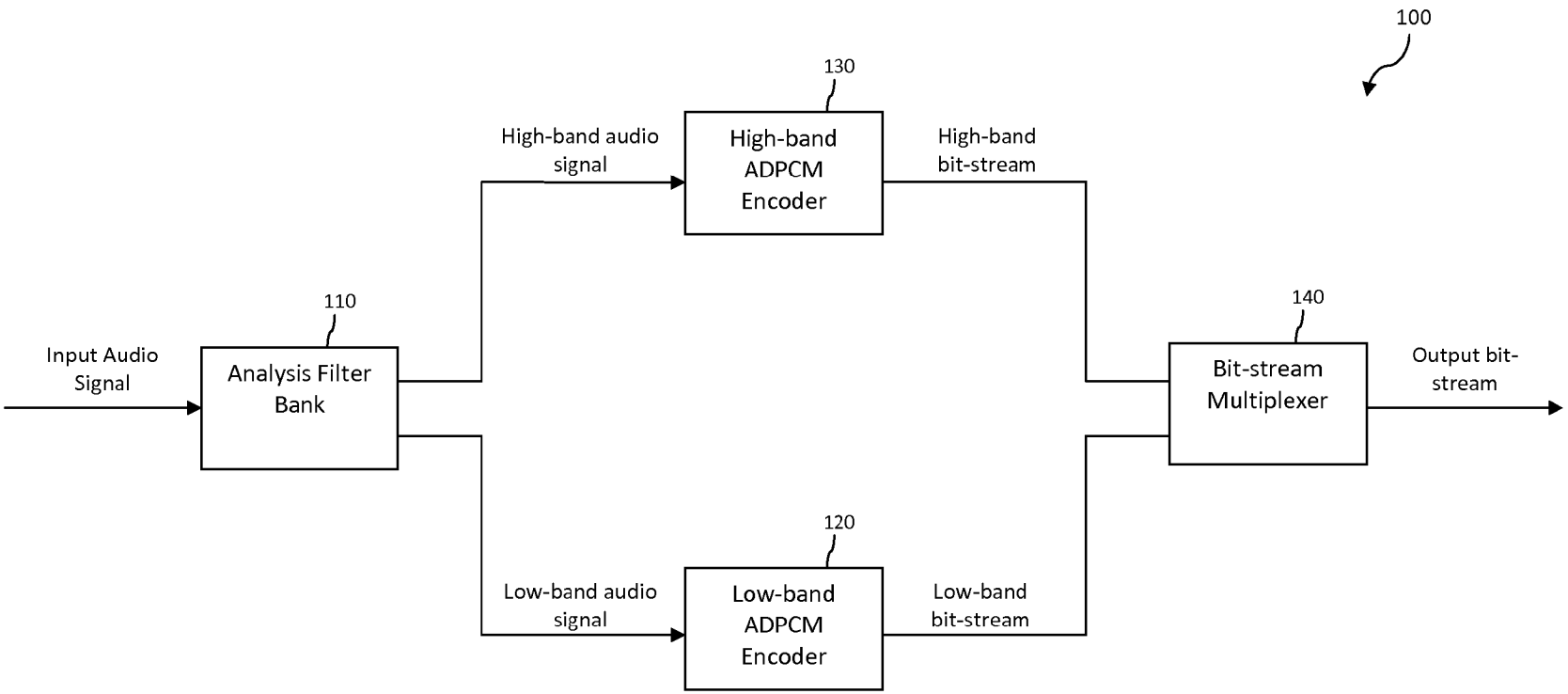
FIG. 1 (PRIOR ART)
FIG. 1 shows an encoder structure of an ITU-T G.722 sub-band predictive coder.

The following detailed description of the present invention refers to the accompanying drawings that illustrate exemplary embodiments consistent with this invention. Other embodiments are possible, and modifications may be made to the illustrated embodiments within the spirit and scope of the present invention. Therefore, the following detailed description is not meant to limit the invention. Rather, the scope of the invention is defined by the appended claims.

It will be apparent to persons skilled in the art that the present invention, as described below, may be implemented in many different embodiments of hardware, software, firmware, and/or the entities illustrated in the drawings. Any actual software code with specialized control hardware to implement the present invention is not limiting of the present invention. Thus, the operation and behavior of the present invention will be described with the understanding that modifications and variations of the embodiments are possible, given the level of detail presented herein.

It should be understood that while the detailed description of the invention set forth herein may refer to the processing of speech signals, the invention may be also be used in relation to the processing of other types of audio signals as well. Therefore, the terms "speech" and "speech signal" are used herein purely for convenience of description and are not limiting. Persons skilled in the relevant art(s) will appreciate that such terms can be replaced with the more general terms "audio" and "audio signal." Furthermore, although speech and audio signals are described herein as being partitioned into frames, persons skilled in the relevant art(s) will appreciate that such signals may be partitioned into other discrete segments as well, including but not limited to sub-frames. Thus, descriptions herein of operations performed on frames are also intended to encompass like operations performed on other segments of a speech or audio signal, such as sub-frames.

Additionally, although the following description discusses the loss of frames of an audio signal transmitted over packet networks (termed "packet loss"), the present invention is not limited to packet loss concealment (PLC). For example, in wireless networks, frames of an audio signal may also be lost or erased due to channel impairments. This condition is termed "frame erasure." When this condition occurs, to avoid substantial degradation in output speech quality, the decoder in the wireless system needs to perform "frame erasure concealment" (FEC) to try to conceal the quality-degrading effects of the lost frames. For a PLC or FEC algorithm, the packet loss and frame erasure amount to the same thing: certain transmitted frames are not available for decoding, so the PLC or FEC algorithm needs to generate a waveform to fill up the waveform gap corresponding to the lost frames and thus conceal the otherwise degrading effects of the frame loss. Because the terms FLC and PLC generally refer to the same kind of technique, they can be used interchangeably. Thus, for the sake of convenience, the term "packet loss concealment," or PLC, is used herein to refer to both.

B. Review of Sub-Band Predictive Coding

In order to facilitate a better understanding of the various embodiments of the present invention described in later Sections, the basic principles of sub-band predictive coding are first reviewed here. In general, a sub-band predictive coder may split an input audio signal into N sub-bands where $N \geqq 2$. Without loss of generality, the two-band predictive coding system of the ITU-T G.722 coder will be described here as an example. Persons skilled in the relevant art(s) will readily be able to generalize this description to any N-band sub-band predictive coder.

FIG. 1 shows a simplified encoder structure 100 of a G.722 sub-band predictive coder. Encoder structure 100 includes an analysis filter bank 110, a low-band adaptive differential pulse code modulation (ADPCM) encoder 120, a high-band ADPCM encoder 130 and a bit-stream multiplexer 140. Analysis filter bank 110 splits an input audio signal into a low-band audio signal and a high-band audio signal. The low-band audio signal is encoded by low-band ADPCM encoder 120 into a low-band bit-stream. The high-band audio signal is encoded by high-band ADPCM encoder 130 into a high-band bit-stream. Bit-stream multiplexer 140 multiplexes the low-band bit-stream and the high-band bit-stream into a single output bit-stream. In the packet transmission applications discussed herein, this output bit-stream is packaged into packets and then transmitted to a sub-band predictive decoder 200, which is shown in FIG. 2.

Figure 2:
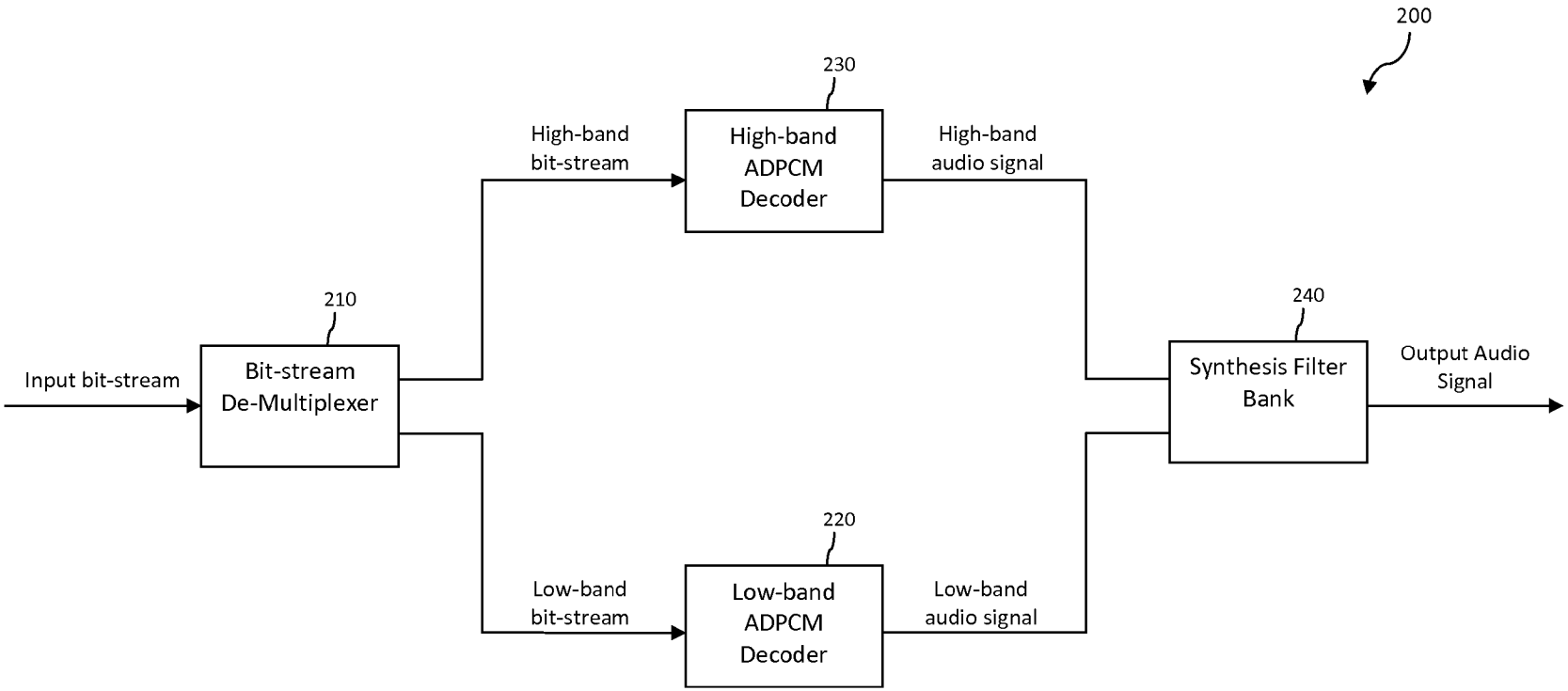
FIG. 2 (PRIOR ART)
FIG. 2 shows a decoder structure of an ITU-T G.722 sub-band predictive coder.

As shown in FIG. 2, decoder 200 includes a bit-stream de-multiplexer 210, a low-band ADPCM decoder 220, a high-band ADPCM decoder 230, and a synthesis filter bank 240. Bit-stream de-multiplexer 210 separates the input bit-stream into the low-band bit-stream and the high-band bit-stream. Low-band ADPCM decoder 220 decodes the low-band bit-stream into a decoded low-band audio signal. High-band ADPCM decoder 230 decodes the high-band bit-stream into a decoded high-band audio signal. Synthesis filter bank 240 then combines the decoded low-band audio signal and the decoded high-band audio signal into the full-band output audio signal.

Figure 3:
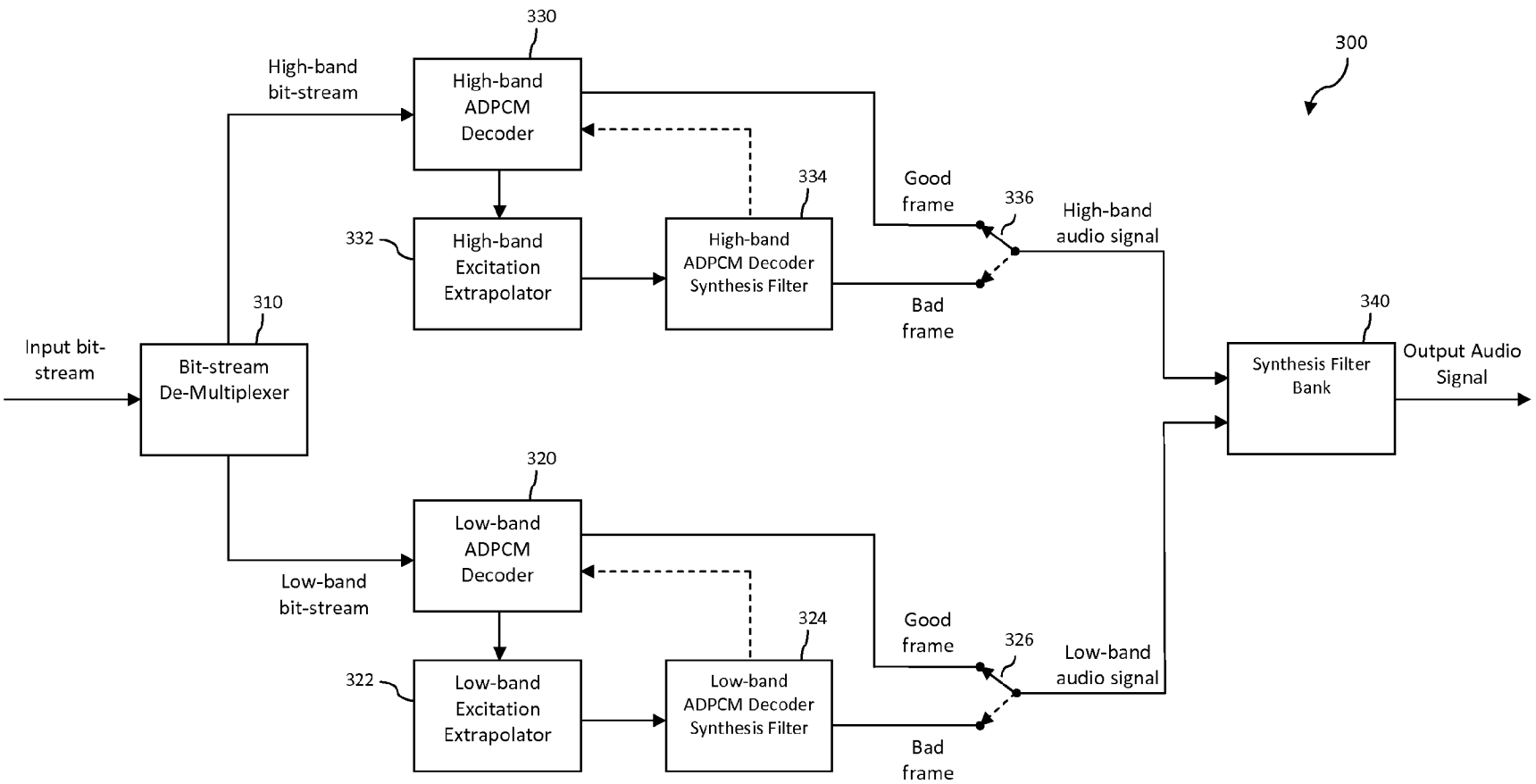
FIG. 3 is a block diagram of a first system that is configured to replace a portion of an audio signal that is deemed lost in a sub-band predictive coder in accordance with an embodiment of the present invention.

C. First Example Embodiment for Performing Packet Loss Concealment in a Sub-Band Predictive Coder Based on Extrapolation of an Excitation Waveform FIG. 3 is a block diagram of a system 300 in accordance with a first example embodiment of the present invention. For convenience, system 300 is described herein as part of an ITU-T G.722 coder, but persons skilled in the relevant art(s) will readily appreciate that the inventive ideas described herein may be generally applied to any N-band sub-band predictive coding system.

As shown in FIG. 3, system 300 includes a bit-stream de-multiplexer 310, a low-band ADPCM decoder 320, a low-band excitation extrapolator 322, a low-band ADPCM decoder synthesis filter 324, a first switch 326, a high-band ADPCM decoder 330, a high-band excitation extrapolator 332, a high-band ADPCM decoder synthesis filter 334, a second switch 336, and a synthesis filter bank 340. Bit-stream de-multiplexer 310 operates in essentially the same manner as bit-stream de-multiplexer 210 of FIG. 2, and synthesis filter bank 340 operates in essentially the same manner as synthesis filter bank 240 of FIG. 2.

The input bit-stream received by system 300 is partitioned into a series of frames. A frame received by system 200 may either be deemed "good," in which case it is suitable for normal decoding, or "bad," in which case it must be replaced. As described above, a "bad" frame may result from a packet loss.

If the frame that is received by system 300 is good, then low-band ADPCM decoder 320 decodes the low-band bit-stream normally into a decoded low-band audio signal. In this case, first switch 326 is connected to the upper position marked "good frame," thus connecting the decoded low-band audio signal to synthesis filter bank 340. Similarly, high-band ADPCM decoder 330 decodes the high-band bit-stream normally into a decoded high-band audio signal. In this case, second switch 336 is connected to the upper position marked "good frame," thus connecting the decoded high-band audio signal to synthesis filter bank 340. Hence, during good frames the system in FIG. 3 operates in an essentially equivalent manner to system 200 of FIG. 2 with one exception—the low-band excitation signals of the signal are stored in low-band excitation extrapolator 322 for possible use in a future bad frame, and likewise the high-band excitation signals of the signal are stored in high-band excitation extrapolator 332 for possible use in a future bad frame.

If the frame that is received by system 300 is bad, then the excitation signal of each sub-band is individually extrapolated from the previous good frames to fill up the gap in the current bad frame. This function is performed by low-band excitation extrapolator 322 and high-band excitation extrapolator 332. There are many excitation extrapolation methods that are well-known in the art. U.S. Pat. No. 5,615,298 provides an example of one such method and is incorporated by reference herein. In general, for voiced frames where the speech waveform is nearly periodic, the excitation waveform also tends to be somewhat periodic and therefore can be extrapolated in a periodic manner to maintain the periodic nature. For unvoiced frames where the speech waveform appears more like noise, the excitation signal also tends to be noise-like, and in this case the excitation waveform can be obtained using a random noise generator with proper scaling. In a transition region of speech, a mixture of periodic extrapolation and noise generator output can be used.

The extrapolated excitation signal of each sub-band is passed through the synthesis filter of the predictive decoder of that sub-band to obtain the reconstructed audio signal for that sub-band. Specifically, the extrapolated low-band excitation signal at the output of low-band excitation extrapolator 322 is passed through low-band ADPCM decoder synthesis filter 324 to obtain a synthesized low-band audio signal. Similarly, the extrapolated high-band excitation signal at the output of high-band excitation extrapolator 332 is passed through high-band ADPCM decoder synthesis filter 334 to obtain a synthesized high-band audio signal.

During processing of a bad frame, first switch 326 and second switch 336 are both at the lower position marked "bad frame." Thus, they will connect the synthesized low-band audio signal and the synthesized high-band audio signal to synthesis filter bank 340, which combines them into a synthesized output audio signal for the current bad frame.

Before the system in FIG. 3 completes the processing for a bad frame, it needs to perform at least one more task: updating the internal states of low-band ADPCM decoder 320 and high-band ADPCM decoder 330. Such internal states include filter coefficients, filter memory, and a quantizer step size. This operation of updating the internal states of each sub-band ADPCM decoder is shown in FIG. 3 as dotted arrows from low-band ADPCM decoder synthesis filter 324 to low-band ADPCM decoder 320 and from high-band ADPCM decoder synthesis filter 334 to high-band ADPCM decoder 330. There are many possible methods for performing this task as will be understood by persons skilled in the art.

A first exemplary technique for updating the internal states of sub-band ADPCM decoders 320 and 330 is to pass the reconstructed sub-band signal through the corresponding ADPCM encoder of that sub-band (blocks 120 and 130 in FIG. 1, respectively). Since each sub-band ADPCM encoder has the same internal states as the corresponding sub-band ADPCM decoder, after encoding the entire current reconstructed frame of the synthesized sub-band signal (the output of either low-band ADPCM decoder synthesis filter 324 or high-band ADPCM decoder synthesis filter 334), the filter coefficients, filter memory, and quantizer step size left at the end of encoding the entire reconstructed frame of synthesized sub-band signal is used to update the corresponding internal states of the ADPCM decoder of that sub-band.

Alternatively, in a second exemplary technique, the extrapolated excitation signal of each sub-band can go through the normal quantization procedure and the normal decoder filtering and decoder filter coefficients updates in order to update the internal states of the ADPCM decoder of that sub-band. In this case, rather than performing an update of such internal states in a separate step, a more efficient approach is to quantize the extrapolated sub-band excitation signal and use the quantized extrapolated excitation signal to drive the sub-band decoder synthesis filter (low-band ADPCM decoder synthesis filter 324 or high-band ADPCM decoder synthesis filter 334) while at the same time updating the filter coefficients following the same coefficient update method used in low-band ADPCM decoder 320 and high-band ADPCM decoder 330. This way, the updating of the internal states will be performed as a by-product of performing the task of low-band ADPCM decoder synthesis filter 324 and high-band ADPCM decoder synthesis filter 334.

There are other methods for updating the internal states. For example, for certain situations or signal segments it may be better to use an averaged version of previous states in previous good frames to update the internal states at the end of the current bad frame, and in some other situations (for example, in a packet loss with very long duration), it may be better to reset all internal states of each sub-band ADPCM decoder to their initial states.

After the internal states of sub-band predictive decoders 320 and 330 are properly updated at the end of a bad frame, the system is then ready to begin processing of the next frame, regardless of whether it is a good frame or a bad frame.

Figure 4:
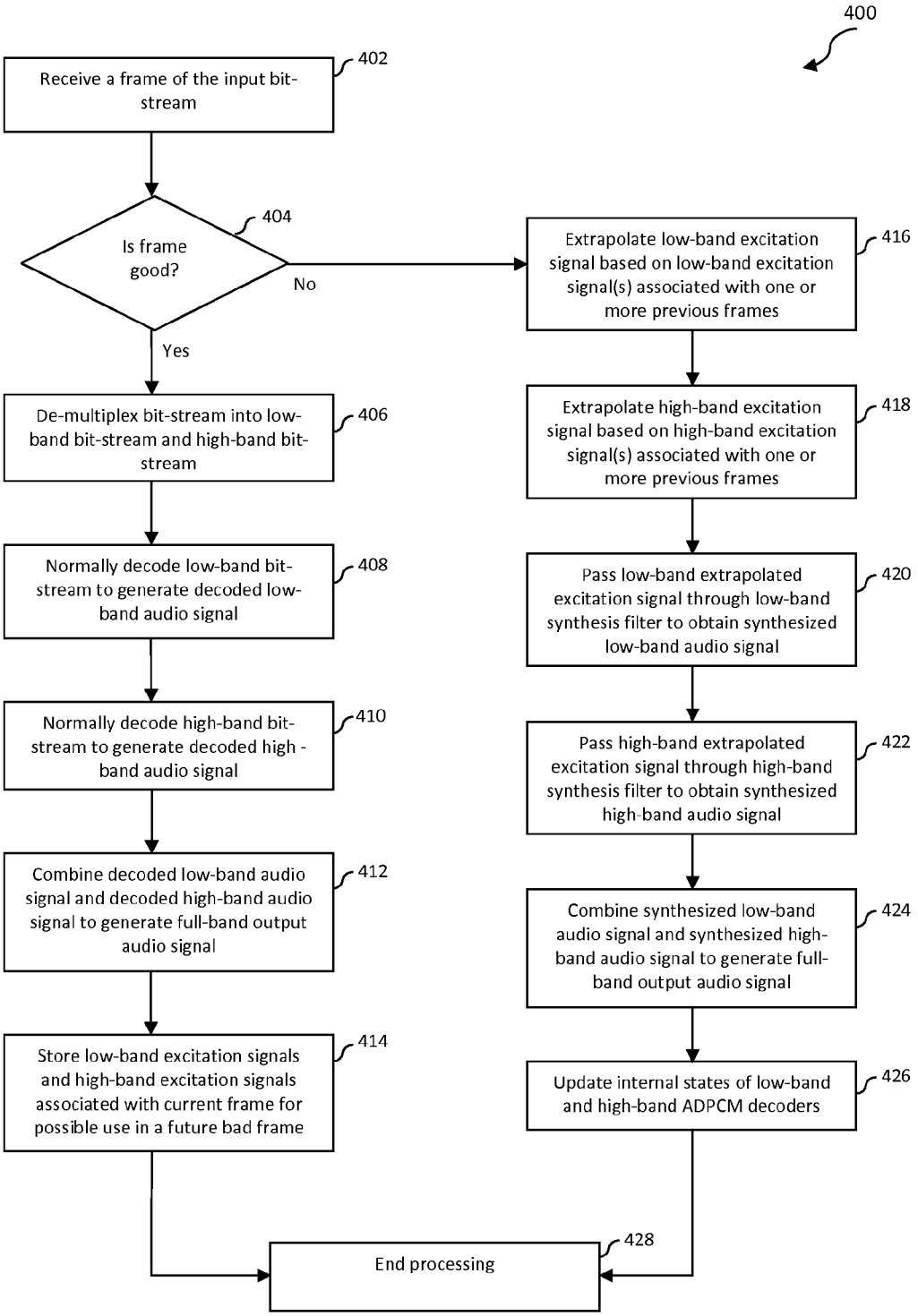
FIG. 4 is a flowchart of a first method for replacing a portion of an audio signal that is deemed lost in a sub-band predictive coder in accordance with an embodiment of the present invention.

To further illustrate this first example embodiment, FIG. 4 illustrates a flowchart 400 of a method by which system 300 operates to process a single frame of an input bit-stream. As shown in FIG. 4, the method of flowchart 400 begins at step 402, in which system 300 receives a frame of the input bit-stream. At decision step 404, system 300 determines whether the frame is good or bad. If the frame is good, then a number of steps are performed starting with step 406. If the frame is bad, then a number of steps are performed starting with step 416.

The series of steps that are performed starting with step 406 in response to receiving a good frame will now be described. At step 406, bit-stream de-multiplexer 310 de-multiplexes a bit-stream associated with the good frame into a low-band bit-stream and a high-band bit-stream. At step 408, low-band ADPCM decoder 320 normally decodes the low-band bit-stream to generate a decoded low-band audio signal. At step 410, high-band ADPCM decoder 330 normally decodes the high-band bit-stream to generate a decoded high-band audio signal. At step 412, synthesis filter bank 340 combines the decoded low-band audio signal and the decoded high-band audio signal to generate a full-band output audio signal. At step 414, low-band excitation signals associated with the current frame are stored in low-band excitation extrapolator 322 for possible use in a future bad frame and high-band excitation signals associated with current frame are stored in high-band excitation extrapolator 332 for possible use in a future bad frame. After step 414, processing associated with the good frame ends, as shown at step 428.

The series of steps that are performed starting with step 416 in response to receiving a bad frame will now be described. At step 416, low-band excitation extrapolator 322 extrapolates a low-band excitation signal based on low-band excitation signal(s) associated with one or more previous frames processed by system 300. At step 418, high-band excitation extrapolator 332 extrapolates a high-band excitation signal based on high-band excitation signal(s) associated with one or more previous frames processed by system 300. At step 420, the low-band extrapolated excitation signal is passed through low-band ADPCM decoder synthesis filter 324 to obtain a synthesized low-band audio signal. At step 422, the high-band extrapolated excitation signal is passed through high-band ADPCM decoder synthesis filter 334 to obtain a synthesized high-band audio signal. At step 424, synthesizer filter bank 340 combines the synthesized low-band audio signal and the synthesized high-band audio signal to generate a full-band output audio signal. At step 426, the internal states of low-band ADPCM decoder 320 and high-band ADPCM decoder 330 are updated. After step 426, processing associated with the bad frame ends, as shown at step 428.

D. Second Example Embodiment for Performing Packet Loss Concealment in a Sub-Band Predictive Coder Based on Extrapolation of an Excitation Waveform In a second example embodiment, sub-band excitation signals associated with one or more previously-received good frames (which are stored in buffers) are first passed through a synthesis filter bank to obtain a full-band excitation signal for the previously-received good frame(s), and then extrapolation is performed on this full-band excitation signal to fill the gap associated with a current bad frame. This full-band extrapolated excitation signal is then passed through an analysis filter bank to split it into sub-band extrapolated excitation signals, which are then passed through sub-band decoder synthesis filters and eventually a synthesis filter bank to produce an output audio signal. The rest of the steps for updating the internal states of the predictive decoder of each sub-band may be performed in a like manner to that described in reference to the first example embodiment above.

Figure 5:
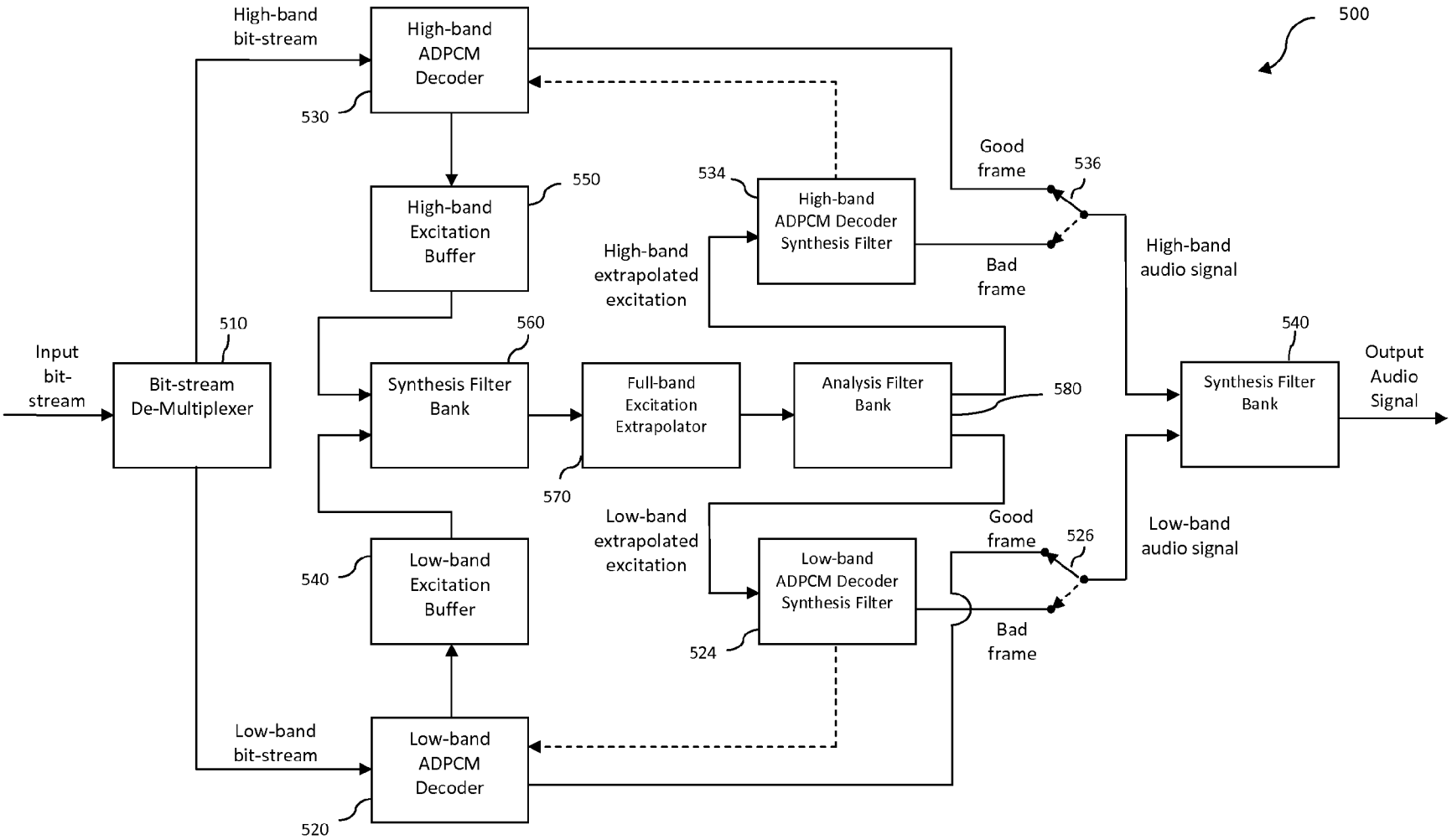
FIG. 5 is a block diagram of a second system that is configured to replace a portion of an audio signal that is deemed lost in a sub-band predictive coder in accordance with an embodiment of the present invention.

A block diagram of this second example embodiment of the present invention is shown in FIG. 5. In the system 500 shown in FIG. 5, like-numbered blocks perform the same functions as in FIG. 3. For example, blocks 520 and 530 perform the same functions as block 320 and 330, respectively. Again, FIG. 5 shows only an exemplary system according to a second example embodiment of the present invention. Those skilled in the art will appreciate that the sub-band predictive coding system can be an N-band system rather than the two-band system shown in FIG. 5, where N can be an integer greater than 2. Similarly, the predictive coder for each sub-band does not have to be an ADPCM coder as shown in FIG. 5, but can be any general predictive coder, and can be either forward-adaptive or backward-adaptive.

Refer now to FIG. 5. When system 500 is processing a good frame, switches 526 and 536 are both in the upper position labeled "good frame," and a bit-stream de-multiplexer 510, a low-band ADPCM decoder 520, a high-band ADPCM decoder 530, and a synthesis filter bank 540 operate in essentially the same manner as bit-stream de-multiplexer 310, low-band ADPCM decoder 320, high-band ADPCM decoder 330, and synthesis filter bank 540, respectively, to decode the input bit-stream normally. In addition, a low-band excitation signal produced in low-band ADPCM decoder 520 during good frames is stored in a low-band excitation buffer 540. Likewise, a high-band excitation signal produced in the high-band ADPCM decoder 530 during good frames is stored in a high-band excitation buffer 550.

When system 500 is processing a bad frame, switches 526 and 536 are both in the lower position labeled "bad frame." In this case, a synthesis filter bank 560 receives a low-band excitation signal from low-band excitation buffer 540 and a high-band excitation signal from high-band excitation buffer 550, and combines the two sub-band excitation signals into a full-band excitation signal. A full-band excitation extrapolator 570 then receives this full-band excitation signal and extrapolates it to fill up the gap associated with the current bad frame. In an embodiment, full-band excitation extrapolator 570 extrapolates the signal beyond the end of the current bad frame in order to compensate for inherent filtering delays in synthesis filter bank 560 and an analysis filter bank 580. Analysis filter bank 580 then splits this full-band extrapolated excitation signal into a low-band extrapolated excitation signal and a high-band extrapolated excitation signal, in the same way the analysis filter bank 110 of FIG. 1 performs its band-splitting function.

A low-band ADPCM decoder synthesis filter 524 then filters the low-band extrapolated excitation signal to produce a synthesized low-band audio signal, and high-band ADPCM decoder synthesis filter 534 then filters the high-band extrapolated excitation signal to produce a high-band synthesized audio signal. These two sub-band audio signals pass through switches 526 and 536 to reach the synthesis filter bank 440, which then combines these two sub-band audio signals into a full-band output audio signal.

Like system 300 of FIG. 3, in system 500 of FIG. 5 the internal states of low-band ADPCM decoder 520 and high-band ADPCM decoder 530 need to be updated to proper values before the normal decoding of the next good frame starts, otherwise significant distortion may result. The update of the internal states of low-band ADPCM decoder 520 and high-band ADPCM decoder 530 can be performed using one of the methods outlines in the description of the first example embodiment above.

Figure 6:
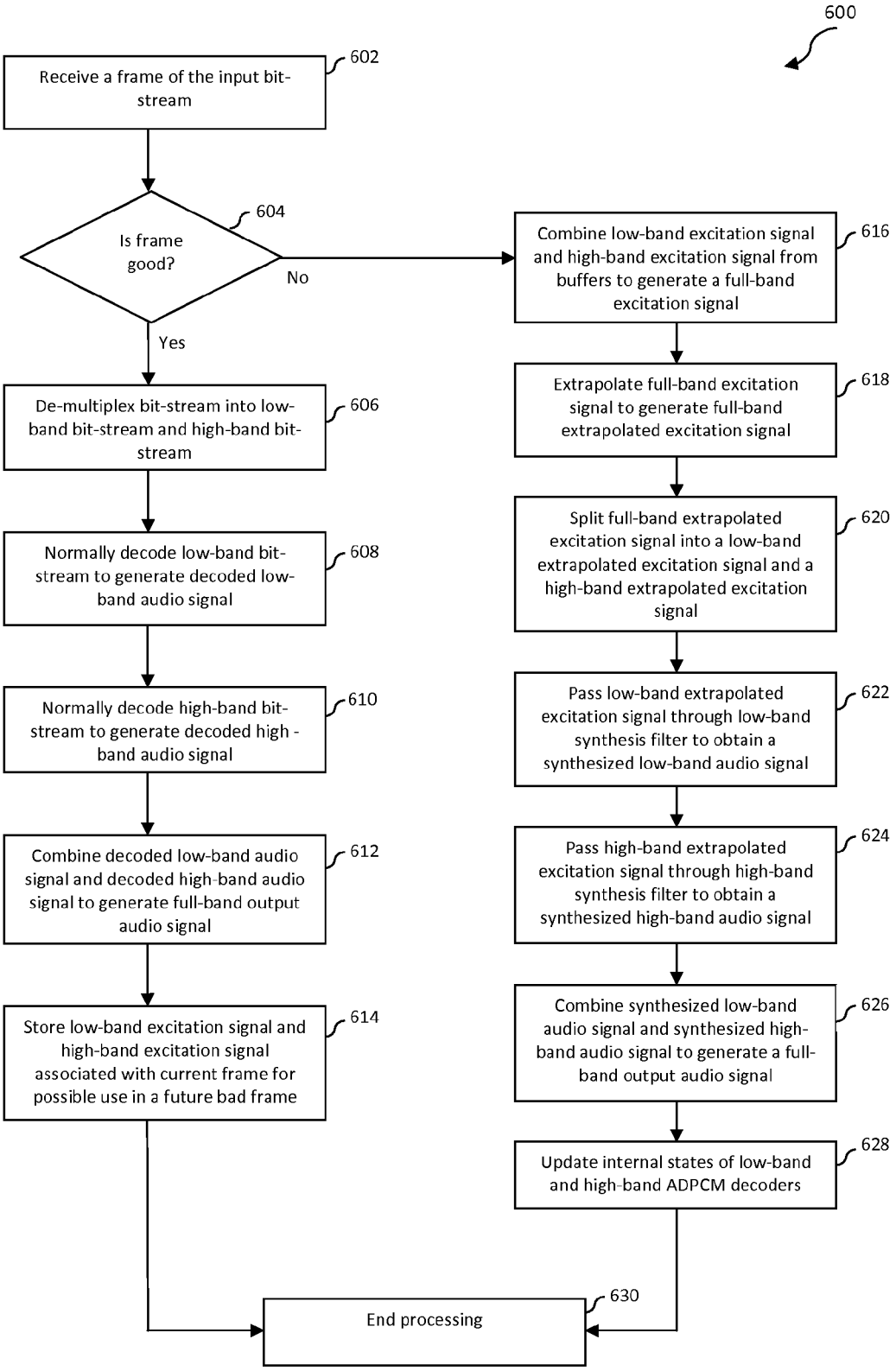
FIG. 6 is a flowchart of a second method for replacing a portion of an audio signal that is deemed lost in a sub-band predictive coder in accordance with an embodiment of the present invention.

To further illustrate this second example embodiment, FIG. 6 illustrates a flowchart 600 of a method by which system 500 operates to process a single frame of an input bit-stream. As shown in FIG. 6, the method of flowchart 600 begins at step 602, in which system 500 receives a frame of the input bit-stream. At decision step 604, system 500 determines whether the frame is good or bad. If the frame is good, then a number of steps are performed starting with step 606. If the frame is bad, then a number of steps are performed starting with step 616.

The series of steps that are performed starting with step 606 in response to receiving a good frame will now be described. At step 606, bit-stream de-multiplexer 510 de-multiplexes a bit-stream associated with the good frame into a low-band bit-stream and a high-band bit-stream. At step 608, low-band ADPCM decoder 520 normally decodes the low-band bit-stream to generate a decoded low-band audio signal. At step 610, high-band ADPCM decoder 530 normally decodes the high-band bit-stream to generate a decoded high-band audio signal. At step 612, synthesis filter bank 540 combines the decoded low-band audio signal and the decoded high-band audio signal to generate a full-band output audio signal. At step 614, a low-band excitation signal associated with the current frame is stored in low-band excitation buffer 540 for possible use in a future bad frame and a high-band excitation signal associated with current frame is stored in high-band excitation buffer 550 for possible use in a future bad frame. After step 614, processing associated with the good frame ends, as shown at step 630.

The series of steps that are performed starting with step 616 in response to receiving a bad frame will now be described. At step 616, synthesis filter bank 560 receives a low-band excitation signal from low-band excitation buffer 540 and a high-band excitation signal from high-band excitation buffer 550, and combines the two sub-band excitation signals into a full-band excitation signal. At step 618, full-band excitation extrapolator 570 receives this full-band excitation signal and extrapolates it to generate a full-band extrapolated excitation signal. At step 620, analysis filter bank 580 splits the extrapolated full-band excitation signal into a low-band extrapolated excitation signal and a high-band extrapolated excitation signal. At step 622, low-band ADPCM decoder synthesis filter 524 filters the low-band extrapolated excitation signal to produce a synthesized low-band audio signal, and at step 624, high-band ADPCM decoder synthesis filter 534 filters the high-band extrapolated excitation signal to produce a high-band synthesized audio signal. At step 626, synthesis filter bank 640 combines the two synthesized sub-band audio signals into a full-band output audio signal. At step 628, the internal states of low-band ADPCM decoder 520 and high-band ADPCM decoder 530 are updated. After step 628, processing associated with the bad frame ends, as shown at step 630.

The main differences between the embodiments of FIG. 5 and FIG. 3 are the addition of synthesis filter bank 560 and analysis filter bank 580, and the fact that the excitation signal is now extrapolated in the full-band domain rather than the sub-band domain. The addition of synthesis filter bank 560 and analysis filter bank 580 can potentially add significant computational complexity. However, extrapolating the excitation signal in the full-band domain provides an advantage. This is explained below.

When system 300 of FIG. 3 extrapolates the high-band excitation signal, there are some potential issues. First, if it does not perform periodic extrapolation for the high-band excitation signal, then the output audio signal will not preserve the periodic nature of the high-band audio signal that can be present in some highly periodic voiced signals. On the other hand, if it performs periodic extrapolation for the high-band excitation signal, even if it uses the same pitch period as used in the extrapolation of the low-band excitation signal to save computation and to ensure that the two sub-band excitation signals are using the same pitch period for extrapolation, there is still another problem. When the high-band excitation signal is extrapolated periodically, the extrapolated high-band excitation signal will be periodic and will have a harmonic structure in its spectrum. In other words, the frequencies of the spectral peaks in the spectrum of the high-band excitation signal will be related by integer multiples. After this high-band excitation signal is passed through high-band ADPCM decoder synthesis filter 334, the spectral peaks of the resulting high-band audio signal will still be harmonically related. However, once this high-band audio signal is re-combined with the low-band audio signal by the synthesis filter bank 340, the spectrum of the high-band audio signal will be "translated" or shifted to the higher frequency, possibly even with mirror imaging taking place. Thus, after such mirror imaging and frequency shifting, there is no guarantee that the spectral peaks in the high band portion of the full-band output audio signal will have frequencies that are still integer multiples of the pitch frequency in the low-band signal. This can potentially cause degradation in the output audio quality of highly periodic voiced signals. In contrast, system 500 in FIG. 5 will not have this problem. Since system 500 performs the excitation signal extrapolation in the full-band domain, the frequencies of the harmonic peaks in the high band is guaranteed to be an integer multiple of the pitch frequency.

In summary, the advantage of this second example embodiment is that for voiced signals the extrapolated full-band excitation signal and the final full-band output audio signal will preserve the harmonic structure of spectral peaks. On the other hand, the first example embodiment has the advantage of lower complexity, but it may not preserve such harmonic structure in the higher sub-bands.

E. Hardware and Software Implementations

Figure 7:
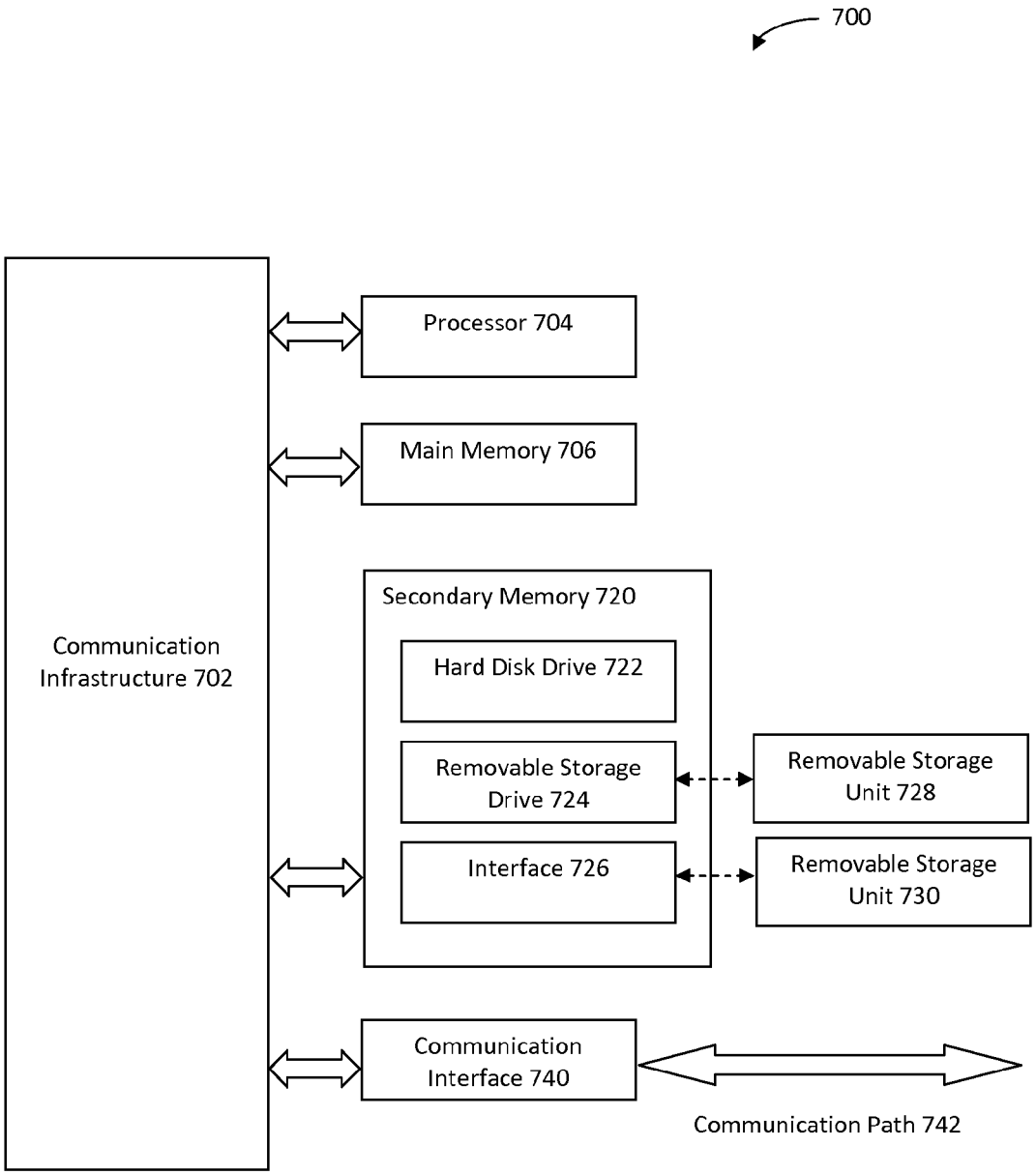
FIG. 7 is a block diagram of a computer system in which embodiments of the present invention may be implemented.

The following description of a general purpose computer system is provided for the sake of completeness. The present invention can be implemented in hardware, or as a combination of software and hardware. Consequently, the invention may be implemented in the environment of a computer system or other processing system. An example of such a computer system 700 is shown in FIG. 7. In the present invention, all of the steps of FIGS. 4 and 6, for example, can execute on one or more distinct computer systems 700, to implement the various methods of the present invention.

Computer system 700 includes one or more processors, such as processor 704. Processor 704 can be a special purpose or a general purpose digital signal processor. The processor 704 is connected to a communication infrastructure 702 (for example, a bus or network). Various software implementations are described in terms of this exemplary computer system. After reading this description, it will become apparent to a person skilled in the relevant art(s) how to implement the invention using other computer systems and/or computer architectures.

Computer system 700 also includes a main memory 706, preferably random access memory (RAM), and may also include a secondary memory 720. The secondary memory 720 may include, for example, a hard disk drive 722 and/or a removable storage drive 724, representing a floppy disk drive, a magnetic tape drive, an optical disk drive, or the like. The removable storage drive 724 reads from and/or writes to a removable storage unit 728 in a well known manner. Removable storage unit 728 represents a floppy disk, magnetic tape, optical disk, or the like, which is read by and written to by removable storage drive 724. As will be appreciated, the removable storage unit 728 includes a computer usable storage medium having stored therein computer software and/or data.

In alternative implementations, secondary memory 720 may include other similar means for allowing computer programs or other instructions to be loaded into computer system 700. Such means may include, for example, a removable storage unit 730 and an interface 726. Examples of such means may include a program cartridge and cartridge interface (such as that found in video game devices), a removable memory chip (such as an EPROM, or PROM) and associated socket, and other removable storage units 730 and interfaces 726 which allow software and data to be transferred from the removable storage unit 730 to computer system 700.

Computer system 700 may also include a communications interface 740. Communications interface 740 allows software and data to be transferred between computer system 700 and external devices. Examples of communications interface 740 may include a modem, a network interface (such as an Ethernet card), a communications port, a PCMCIA slot and card, etc. Software and data transferred via communications interface 740 are in the form of signals which may be electronic, electromagnetic, optical, or other signals capable of being received by communications interface 740. These signals are provided to communications interface 740 via a communications path 742. Communications path 742 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 728 and 730, a hard disk installed in hard disk drive 722, and signals received by communications interface 740. These computer program products are means for providing software to computer system 700.

Computer programs (also called computer control logic) are stored in main memory 706 and/or secondary memory 720. Computer programs may also be received via communications interface 740. Such computer programs, when executed, enable the computer system 700 to implement the present invention as discussed herein. In particular, the computer programs, when executed, enable the processor 700 to implement the processes of the present invention, such as any of the methods described herein. Accordingly, such computer programs represent controllers of the computer system 700. Where the invention is implemented using software, the software may be stored in a computer program product and loaded into computer system 700 using removable storage drive 724, interface 726, or communications interface 740.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

F. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A system for replacing a portion of an audio signal that is deemed lost in a sub-band predictive coder, comprising:

a first excitation extrapolator implemented in at least one processor and configured to generate a first sub-band extrapolated excitation signal based on a first sub-band excitation signal associated with one or more previously-received portions of the audio signal only when a current portion of the audio signal is deemed lost;

a second excitation extrapolator configured to generate a second sub-band extrapolated excitation signal based on a second sub-band excitation signal associated with one or more previously-received portions of the audio signal only when the current portion of the audio signal is deemed lost;

a first synthesis filter configured to filter the first sub-band extrapolated excitation signal to generate a synthesized first sub-band audio signal only when the current portion of the audio signal is deemed lost;

a second synthesis filter configured to filter the second sub-band extrapolated excitation signal to generate a synthesized second sub-band audio signal only when the current portion of the audio signal is deemed lost; and a synthesis filter bank configured to combine at least the synthesized first sub-band audio signal and the synthesized second sub-band audio signal to generate a full-band output audio signal corresponding to the portion of the audio signal that is deemed lost.

2. The system of claim 1, further comprising:

a first decoder configured to decode a first sub-band bit-stream associated with a portion of the audio signal that is not deemed lost; and a second decoder configured to decode a second sub-band bit-stream associated with the portion of the audio signal that is not deemed lost.

3. The system of claim 2, wherein:

the first decoder is a low-band adaptive pulse code modulation (ADPCM) decoder;

the second decoder is a high-band ADPCM decoder;

the first synthesis filter is a low-band ADPCM decoder synthesis filter; and the second synthesis filter is a high-band ADPCM decoder synthesis filter.

4. The system of claim 2, further comprising:

a bit-stream de-multiplexer configured to de-multiplex an input bit-stream into the first sub-band bit-stream and the second sub-band bit-stream.

5. The system of claim 2, further comprising:

logic configured to update internal states of the first decoder and the second decoder after generation of the synthesized first sub-band audio signal and generation of the synthesized second sub-band audio signal, respectively.

6. The system of claim 5, wherein the logic configured to update internal states of the first decoder and the second decoder comprises:

first logic configured to pass the synthesized first sub-band audio signal through a first encoder; and second logic configured to pass the synthesized second sub-band audio signal through a second encoder.

7. The system of claim 5, wherein the logic configured to update internal states of the first decoder and the second decoder comprises:

first logic configured to quantize the first sub-band extrapolated excitation signal and to use the quantized first sub-band extrapolated excitation signal to drive the first synthesis filter; and second logic configured to quantize the second sub-band extrapolated excitation signal and to use the quantized second sub-band extrapolated excitation signal to drive the second synthesis filter.

8. A method for replacing a portion of an audio signal that is deemed lost in a sub-band predictive coder, comprising:

determining whether a current portion of the audio signal is deemed lost;

generating a first sub-band extrapolated excitation signal based on a first sub-band excitation signal associated with one or more previously-received portions of the audio signal only when the current portion of the audio signal is deemed lost;

generating a second sub-band extrapolated excitation signal based on a second sub-band excitation signal associated with one or more previously-received portions of the audio signal only when the current portion of the audio signal is deemed lost;

filtering the first sub-band extrapolated excitation signal in a first synthesis filter to generate a synthesized first sub-band audio signal only when the current portion of the audio signal is deemed lost;

filtering the second sub-band extrapolated excitation signal in a second synthesis filter to generate a synthesized second sub-band audio signal only when the current portion of the audio signal is deemed lost; and combining at least the synthesized first sub-band audio signal and the synthesized second sub-band audio signal to generate a full-band output audio signal corresponding to the portion of the audio signal that is deemed lost.

9. The method of claim 8, further comprising:

decoding a first sub-band bit-stream associated with a portion of the audio signal that is not deemed lost in a first decoder; and decoding a second sub-band bit-stream associated with the portion of the audio signal that is not deemed lost in a second decoder.

10. The method of claim 9, wherein:

the first decoder is a low-band adaptive pulse code modulation (ADPCM) decoder;

the second decoder is a high-band ADPCM decoder;

the first synthesis filter is a low-band ADPCM decoder synthesis filter; and the second synthesis filter is a high-band ADPCM decoder synthesis filter.

11. The method of claim 9, further comprising:

de-multiplexing an input bit-stream into the first sub-band bit-stream and the second sub-band bit-stream.

12. The method of claim 9, further comprising:

updating internal states of the first decoder and the second decoder after generation of the synthesized first sub-band audio signal and generation of the synthesized second sub-band audio signal, respectively.

13. The method of claim 12, wherein updating internal states of the first decoder and the second decoder comprises:

passing the synthesized first sub-band audio signal through a first encoder; and passing the synthesized second sub-band audio signal through a second encoder.

14. The method of claim 12, wherein updating internal states of the first decoder and the second decoder comprises:

quantizing the first sub-band extrapolated excitation signal;

using the quantized first sub-band extrapolated excitation signal to drive the first synthesis filter;

quantizing the second sub-band extrapolated excitation signal; and using the quantized second sub-band extrapolated excitation signal to drive the second synthesis filter.

15. A system for replacing a portion of an audio signal that is deemed lost in a sub-band predictive coder, comprising:

a first synthesis filter bank configured to combine at least a first sub-band excitation signal associated with one or more previously-received portions of the audio signal and a second sub-band excitation signal associated with one or more previously-received portions of the audio signal to generate a full-band excitation signal only when a current portion of the audio signal is deemed lost;

a full-band excitation extrapolator implemented in at least one processor and configured to receive the full-band excitation signal and generate a full-band extrapolated excitation signal therefrom only when the current portion of the audio signal is deemed lost;

an analysis filter bank configured to split the full-band extrapolated excitation signal into at least a first sub-band extrapolated excitation signal and a second sub-band extrapolated excitation signal only when the current portion of the audio signal is deemed lost;

a first synthesis filter configured to filter the first sub-band extrapolated excitation signal to generate a synthesized first sub-band audio signal only when the current portion of the audio signal is deemed lost;

a second synthesis filter configured to filter the second sub-band extrapolated excitation signal to generate a synthesized second sub-band audio signal only when the current portion of the audio signal is deemed lost; and a second synthesis filter bank configured to combine at least the synthesized first sub-band audio signal and the synthesized second sub-band audio signal to generate a full-band output audio signal corresponding to the portion of the audio signal that is deemed lost.

16. The system of claim 15, further comprising:

a first decoder configured to decode a first sub-band bit-stream associated with a portion of the audio signal that is not deemed lost; and a second decoder configured to decode a second sub-band bit-stream associated with the portion of the audio signal that is not deemed lost.

17. The system of claim 16, wherein:

the first decoder is a low-band adaptive pulse code modulation (ADPCM) decoder;

the second decoder is a high-band ADPCM decoder;

the first synthesis filter is a low-band ADPCM decoder synthesis filter; and the second synthesis filter is a high-band ADPCM decoder synthesis filter.

18. The system of claim 16, further comprising:

a bit-stream de-multiplexer configured to de-multiplex an input bit-stream into the first sub-band bit-stream and the second sub-band bit-stream.

19. The system of claim 16, further comprising:

logic configured to update internal states of the first decoder and the second decoder after generation of the synthesized first sub-band audio signal and generation of the synthesized second sub-band audio signal, respectively.

20. The system of claim 19, wherein the logic configured to update internal states of the first decoder and the second decoder comprises:

first logic configured to pass the synthesized first sub-band audio signal through a first encoder; and second logic configured to pass the synthesized second sub-band audio signal through a second encoder.

21. The system of claim 19, wherein the logic configured to update internal states of the first decoder and the second decoder comprises:

first logic configured to quantize the first sub-band extrapolated excitation signal and to use the quantized first sub-band extrapolated excitation signal to drive the first synthesis filter; and second logic configured to quantize the second sub-band extrapolated excitation signal and to use the quantized second sub-band extrapolated excitation signal to drive the second synthesis filter.

22. A method for replacing a portion of an audio signal that is deemed lost in a sub-band predictive coder, comprising:

determining whether a current portion of the audio signal is deemed lost;

combining at least a first sub-band excitation signal associated with one or more previously-received portions of the audio signal and a second sub-band excitation signal associated with one or more previously-received portions of the audio signal to generate a full-band excitation signal only when the current portion of the audio signal is deemed lost;

generating a full-band extrapolated excitation signal based on the full-band excitation signal only when the current portion of the audio signal is deemed lost;

splitting the full-band extrapolated excitation signal into at least a first sub-band extrapolated excitation signal and a second sub-band extrapolated excitation signal only when the current portion of the audio signal is deemed lost;

filtering the first sub-band extrapolated excitation signal in a first synthesis filter to generate a synthesized first sub-band audio signal only when the current portion of the audio signal is deemed lost;

filtering the second sub-band extrapolated excitation signal in a second synthesis filter to generate a synthesized second sub-band audio signal only when the current portion of the audio signal is deemed lost; and combining at least the synthesized first sub-band audio signal and the synthesized second sub-band audio signal to generate a full-band output audio signal corresponding to the portion of the audio signal that is deemed lost.

23. The method of claim 22, further comprising:

decoding a first sub-band bit-stream associated with a portion of the audio signal that is not deemed lost in a first decoder; and decoding a second sub-band bit-stream associated with the portion of the audio signal that is not deemed lost in a second decoder.

24. The method of claim 23, wherein:

the first decoder is a low-band adaptive pulse code modulation (ADPCM) decoder;

the second decoder is a high-band ADPCM decoder;

the first synthesis filter is a low-band ADPCM decoder synthesis filter; and the second synthesis filter is a high-band ADPCM decoder synthesis filter.

25. The method of claim 23, further comprising:

de-multiplexing an input bit-stream into the first sub-band bit-stream and the second sub-band bit-stream.

26. The method of claim 23, further comprising:

updating internal states of the first decoder and the second decoder after generation of the synthesized first sub-band audio signal and generation of the synthesized second sub-band audio signal, respectively.

27. The method of claim 26, wherein updating internal states of the first decoder and the second decoder comprises:

passing the synthesized first sub-band audio signal through a first encoder; and passing the synthesized second sub-band audio signal through a second encoder.

28. The method of claim 26, wherein updating internal states of the first decoder and the second decoder comprises:

quantizing the first sub-band extrapolated excitation signal;

using the quantized first sub-band extrapolated excitation signal to drive the first synthesis filter;

quantizing the second sub-band extrapolated excitation signal; and using the quantized second sub-band extrapolated excitation signal to drive the second synthesis filter.

* * * * *